United States Patent [19]

Webb

[11] 3,998,443

[45] Dec. 21, 1976

[54] MULTIDIRECTIONAL SHOCK ABSORBING DEVICE

[75] Inventor: Derrel D. Webb, Houston, Tex.

[73] Assignee: Edwin A. Anderson, Houston, Tex. ; a part interest

[22] Filed: Feb. 18, 1975

[21] Appl. No.: 550,358

[52] U.S. Cl. ..... 267/125; 64/23; 175/322

[51] Int. Cl.[2] ..... E21B 17/00; F16D 3/12

[58] Field of Search ..... 267/124, 125, 136, 137; 64/1 V, 23, 28 R, 30 A; 175/319–323

[56] References Cited

UNITED STATES PATENTS

| | | | |
|---|---|---|---|
| 2,754,086 | 7/1956 | Summers | 175/322 |
| 2,795,398 | 6/1957 | Ragland | 64/23 X |
| 3,230,740 | 1/1966 | Fox | 175/322 X |
| 3,301,009 | 1/1967 | Coulter | 175/321 X |
| 3,339,380 | 9/1967 | Fox | 175/321 X |
| 3,350,900 | 11/1967 | Harrison | 64/23 |

*Primary Examiner*—Johnny D. Cherry
*Attorney, Agent, or Firm*—Jack W. Hayden

[57] ABSTRACT

A housing with a mandrel therein is adapted to be connected in a rotary drill string. The housing and mandrel are constructed and arranged to support the work load of the rotary drill string as well as dissipate both longitudinal and radial impact or shock loads that the drill string may encounter. The construction also includes means whereby radial impacts applied to the drilling assembly are connected or translated into longitudinal components of force so that various combinations of longitudinal and/or radial impact or shock loading of the drill string may be dissipated in a manner to inhibit damage to the drill string and its components.

18 Claims, 6 Drawing Figures

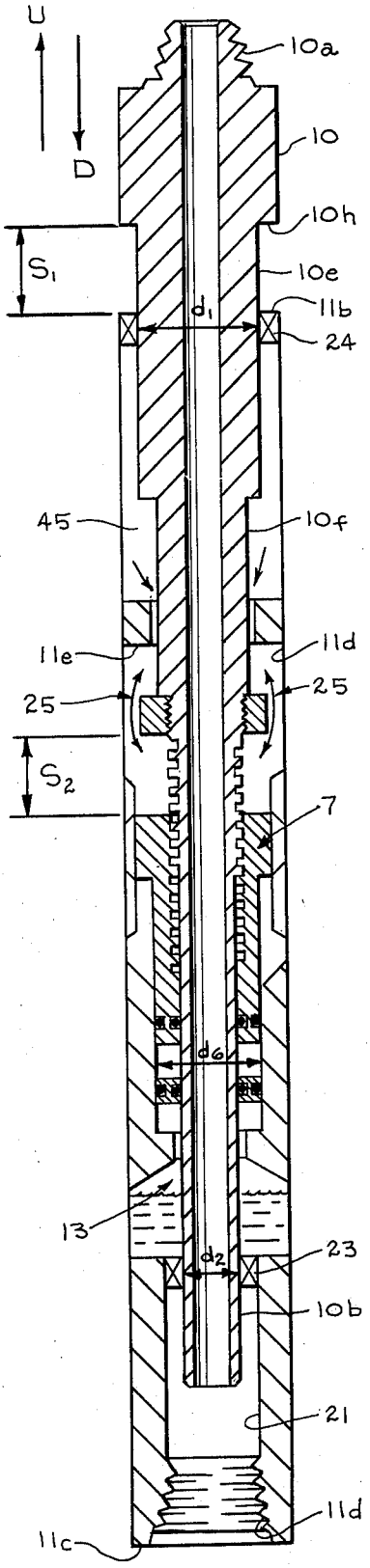
fig. 4
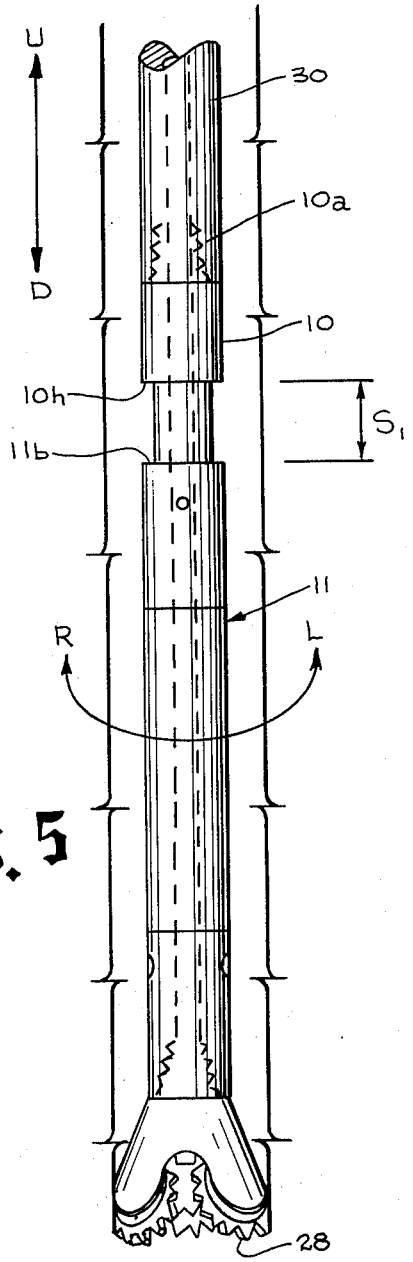
fig. 5
fig. 6
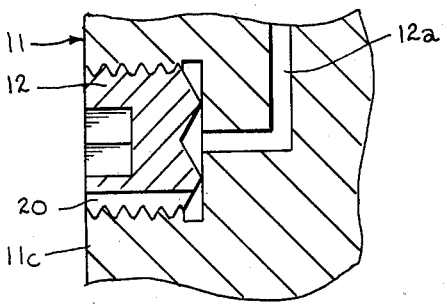

MULTIDIRECTIONAL SHOCK ABSORBING DEVICE

SUMMARY OF THE INVENTION

The prior art with which applicant is familiar includes: U.S. Pat. No. 3,382,936; and the articles "Vibrational Forces in Motions in Rotary Drill String" by D. D. Daereing, Professor of Engineering Science, University of Arkansas, Fayetteville, Arkansas presented at 1972 Rotary Drilling Conference International Association of Drilling Contractors, Dallas, Texas, Feb. 23 – 25, 1972; and "Practical Application of Down Hole Vibration Dampeners" by Charles E. Miller; Drillco, Division of Smith International, Inc., Houston, Texas, presented at 1972 Rotary Drilling Conference International Association of Drilling Contractors, Dallas, Texas, Feb. 23 – 25, 1972.

In the rotary drilling of oil, gas and water wells, long slender pipe such as drill pipe and drill collars are employed which, from a mechanical point of view may be considered as a "long beam". The drill strings and drill collars used in rotary drilling experience various loads, as well as longitudinal and radial shock loads which tend to bend, buckle, vibrate or in some instances cause separation of the drill string.

Numerous conditions arise during the rotary drilling operations which cause either an uneven rotational and/or vertical load to be induced into the drilling assembly including the drill string. For example, certain earth formation conditions may be encountered such as hard rock as well as soft sticky earth formations that may cause uneven rotational and vertical or longitudinal loads to be induced or applied to the drilling string.

Additionally, in other drilling operations such as on offshore floating drilling vessels, shifting or movement of the drilling vessel may be sufficient to cause uneven loading of the drill bit and drill string and may cause large magnitude shock loads to be introduced to the drill assembly including the drill string.

As previously noted, the drill string in effect is a long beam which is relatively stiff and unyielding and heretofore much attention has been given to an endeavor to dampen out very short high intensity shock forces that are encountered by the drill bit. Sometimes the shock forces may be caused by certain types of drill bits drilling particular types of earth formations.

So far as known to applicant, most consideration in shock absorbing and vibration dampening devices currently available on the market or heretofore used have been concerned with relatively small, and relatively short duration, high magnitude load applications. Also, so far as known to applicant, most of these devices are primarily concerned with only the vertical component or the radial component of the shock loading that is, either the "bounce" or vertical motion of the drill string is dampened, while other devices may also dampen out relatively short vibrations in a radial or rotational direction in a drill string.

However, so far as known to applicant, there is no prior art structure which will substantially dampen or even out both rotation, or radial, and vertical, or longitudinal, vibrations of the drill string in any combination either up or down or right or left which may be caused by a number of different situations or conditions during the rotary drilling operation.

It appears to be well known in the art that long heavy drill strings immediately above the drill bit can accumulate energy similar to the principle of energy accumulation in large fly wheels. It is also commonly realized that when large fly wheels are suddenly brought to rest they give up their energy in direct proportion to the time required to stop the fly wheel. It can be appreciated that forces required to stop large fly wheels may be enormously high and their force may be commonly used to do heavy work jobs in industry. However, in rotary drill strings when the lower end thereof is suddenly stopped for any reason, such as by way of example by bit hangup, enormous shock loads may be developed in the drill string which, if undampened, tend to destroy the drill string connections, the drill bit or other elements in the drilling assembly.

One of the most critical factors in energy build-up and its dissipation is time.

For example, when the drill bit hangs up in the well bore for any reason such as, by way of example, broken metal objects, or in any type formation, it can be appreciated that considerable impact energy is present and transmitted to the drill string and its components in a relatively short period of time. Also when a bit is lifted up off the bottom of the well bore due to heaving seas when drilling operations are conducted from a floating vessel, the drill string is subjected to impact loading in a relatively short time. Similarly, if the driller at the surface of the earth allows a rapidly spinning bit to slam down on the bottom of the well bore which tends to stop its rotation, considerable radial and longitudinal impact to the bit and drill string will occur.

A primary object of the present invention is to provide a device which dissipates both longitudinal and radial shock loads over as long a time period as possible so as to slow the energy dissipation and prevent huge build-up of both radial and vertical shock loads in the rotary drill string.

Still another object of the present invention is to provide a device to dissipate or dampen shock loads encountered during rotary drilling operations over as long a time period as possible to minimize the shock transmitted to the rotary drill string either from longitudinal shock loads in an up or down direction and/or radial shock loads in a right or left direction.

Yet a further object of the present invention is to provide a device for substantially dampening or evening out both rotational and vertical vibrations of a rotary drill string and to translate rotational shock loads applied to the drill string to a vertical or longitudinal component.

Still another object of the present invention is to provide a device which can support normal drilling loads and absorb rotational and longitudinal shock applied to the drilling string by converting both the working load and rotational or vertical shock loads into a single component load.

Still another object of the present invention is to provide a device for dampening and absorbing rotational and vertical shocks in rotary drill strings which has long and adjustable magnitudes of displacement due to rotational and longitudinal load placement.

Still another object of the present invention is to provide a device which has maximum yieldable reaction to working loads and shock loads in a drilling string.

Yet a further object of the present invention is to provide a device which both supports the work load of a drilling string and simultaneously dampens out or restricts wide fluctuations of such work load.

Other objects and advantages of the invention will become apparent from a consideration of the following description and drawings.

BRIEF DESCRIPTION OF THE DRAWINGS

FIG. 4 is a diagramatic view illustrating the relationship between the components of the invention that cooperate to perform the shock absorbing or dampening effect desired;

FIG. 5 is a schematic elevation of the present invention showing it in position in a drill string above a drill bit for absorbing the normal drilling load as well as both rotational and longitudinal shock loading of the drill string; and FIG. 6 is a view similar to FIG. 3 showing an alternate form of fill plug.

DESCRIPTION OF THE PREFERRED EMBODIMENT

Figure 1:
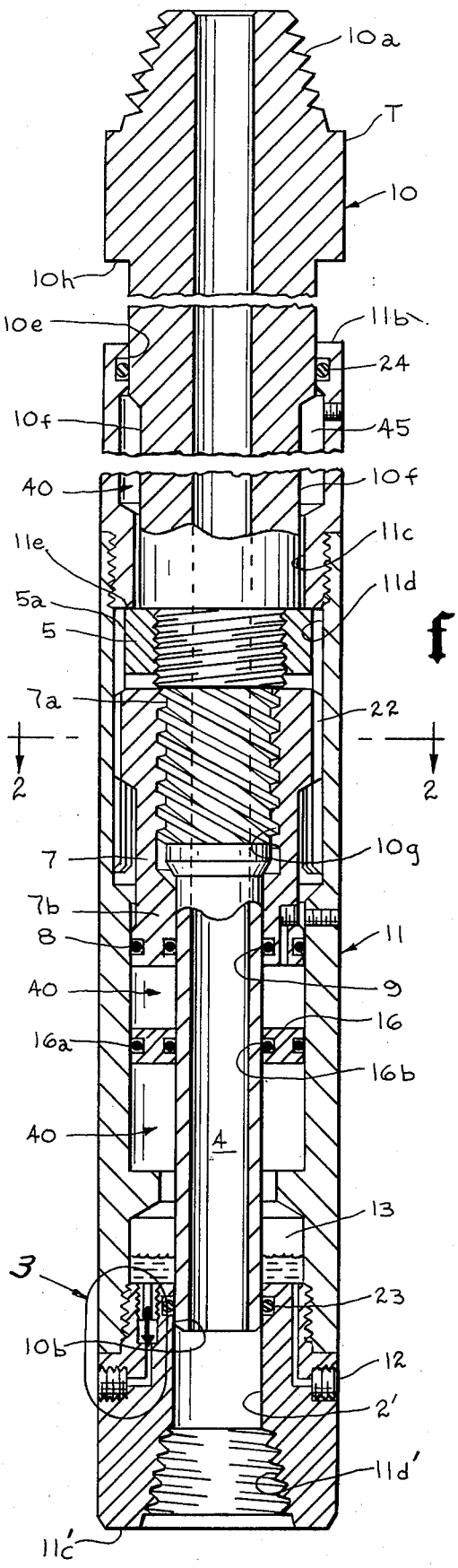
FIG. 1 is a vertical sectional view illustrating a preferred embodiment of the invention.
Figure 2:
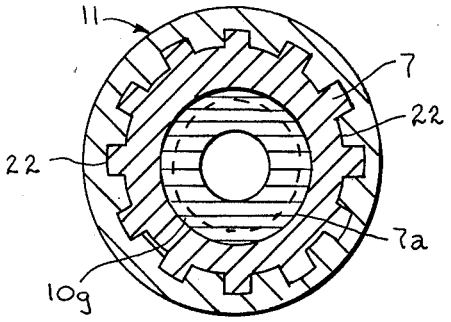
FIG. 2 is a cross sectional view on the line 2 — 2 of FIG. 1, showing in greater detail the structural components of the invention.

Attention is first directed to FIG. 1 of the drawings wherein the invention is referred to generally by the letter T. The housing 11 surrounds and telescopically receives the mandrel 10 therein which mandrel projects from one end 11*b* of the housing 11 as illustrated in FIG. 1 of the drawings. The second end 11*c'* of the housing is provided with a suitable thread means 11*d'* for engaging the housing with the drill string or drill bit.

Similarly, the mandrel 10 is provided with threads 10*a* at one end for engaging with the drill string and the second end 10*b* of the mandrel 10 telescopically and slidably fits within the bore 2' communicating with the end 11*c* of the housing 11. Suitable seal means as illustrated at 23 are provided between the mandrel end 10*b* and the bore 2' of the housing and seal means 24 are provided between the housing 11 adjacent the end 11*b* of the housing and the mandrel portion 10*e*.

It will be noted that the area of the mandrel portion 10*e* which slidably contacts the seal 24 of the housing 11 is substantially larger than the diameter of the mandrel portion 10*b* which slidably engages the seal means 23 for a purpose as will be discussed hereinafter.

Additionally, the housing 11, seals 23 and 24, respective mandrel portions 10*b* and 10*e* cooperate to form a chamber referred to generally at 40 in housing 11 extending between such seal means 23 and 24.

In addition to the elongated tubular extension 10*b* at the lower end of the mandrel 10, such mandrel includes the portion 10*f* which is reduced in diameter relative to the portion 10*e* and at the end of the portion 10*f*, there is an annular enlargement 5 on the mandrel as shown in FIG. 1. The enlargement 5 may be secured to the mandrel 10 by any suitable means such as threads as shown, or the like.

In addition, the mandrel carries the means or piston means referred to generally at 7 thereon, such piston means and mandrel having cooperating thread means 7*a* and 10*g* respectively whereby such piston means may move longitudinally relative to the mandrel in a manner and for a purpose to be described.

To accommodate longitudinal movement of the piston means 7 relative to the housing 11 and to translate radial forces into longitudinal components, in addition to the thread 7*a* and 10*g* there is provided the splined arrangement referred to at 22 between the piston means 7 and the housing 11, which splined means comprises a plurality of circumferentially arranged vertical slots and projections both on the housing and the piston means 7 which interengage to accommodate longitudinal movement of the piston means 7.

The threaded portions 7*a* and 10*g* are of suitable longitudinal extent to accommodate desired or necessary movement of the piston means 7 for dissipating rotational impacts applied to the drilling string during rotary drilling operation.

A portion 7*b* of the piston means 7 surrounds the elongated portion 10*b* of the mandrel as shown in FIG. 1 and includes seal means 8 and 9 respectively for engaging with the housing 11 and the portion 10*b* of the mandrel 10 to thereby separate chamber 40 into an upper or second chamber which may be referred to at 45 which extends from seal means 8 and 9 upwardly to seal means 24 and a lower or first chamber referred to generally at 13 which extends from seal means 8 and 9 downwardly to seal means 23 within housing 11.

It can be appreciated that the mandrel 10 is provided with a bore 4 extending therethrough which communicates with the bore 2' of the housing to provide a means for communicating drilling liquids from the drill string connected to the mandrel 10 therethrough and to the drill bit or drill string connected to the housing 11 without communicating with the chamber 40 formed in the device.

Figure 3:
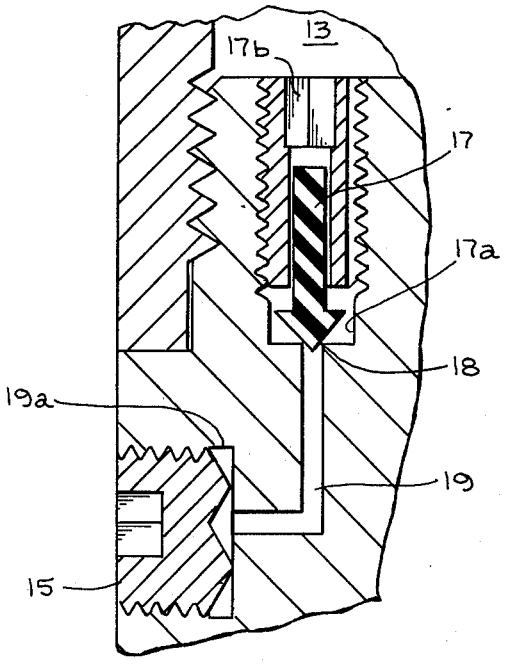
FIG. 3 is an enlarged partial view of the portion circled in FIG. 1 to illustrate one form of suitable means of loading or charging the invention with fluid.

FIG. 3 illustrates one suitable arrangement for charging lower chamber 13 and is shown as including check valve means 17 retained within passage 17*a* by suitable means such as a set screw 17*b* or the like. The check valve 17 is adapted to seat on seat 18 at the end of passage or bore 17*a*, and bore 17*a* in turn communicates with passage 19 that terminates at counterbore 19*a*. An initial fluid pressure charge may be injected through the valve assembly as shown in FIG. 3 by removing plug 15 from counterbore 19*a* and injection of fluid in 19 and 19*a* will cause unseating of one-way check valve 17 so that fluid may flow through passage means 17*a* into lower chamber 13. Thereafter plug 15 may be threadedly secured in counterbore 19*a*.

If desired, other fill plugs referred to generally at 12 may be provided in housing 11 which close off passage means 12*a* communicating with chamber 13. Plugs 12 aid in discharging fluid from the device when desired and purging of the chamber 13 when filling and charging with fluid. Suitable means such as slot 20 may be provided in plug 12 as shown in FIG. 6 to enable any liquid and gases that are initially placed in chamber 13 to slowly dissipate or bleed therefrom so as to enable the plug 12 to be slightly unscrewed to release any pressure in passage 12*a* before removing plug 12.

It can be appreciated that the upper chamber 45 is filled with substantially a noncompressible fluid medium such as lubricating oil, grease or the like when the mandrel and housing 11 are assembled.

After the housing 11 and mandrel 10 have been assembled as illustrated in FIGS. 1 and 4, the lower chamber 13 may be charged with a substantially compressible fluid such as gas or gas with miscible liquids or suitable compressible liquids. Suitable mediums which are inert such as nitrogen, and/or silicons serve the purpose quite well.

It can be further appreciated that the housing 11 and mandrel 10 may be formed of any suitable number of component parts to enable their assembly and relative positioning in such telescoped relation as illustrated in FIG. 1 of the drawings.

The lower chamber 13 is illustrated as including a movable barrier 16 having seal means 16*a* and 16*b* respectively for engaging with the housing 11 and mandrel portion 10*b* for a purpose as will be described. It can be appreciated that in some circumstances the barrier 16 may be eliminated.

It will be noted that the portion 10*f* of the mandrel extends through the housing portion referred to at 11*c* which is reduced in internal diameter to provide relatively small clearance between the mandrel portion 10*f* and housing portion 11*c*, thereby forming restriction means to restrict flow of liquid during relative movement between the mandrel 10 and housing 11 to accomplish the desired dampening effect.

In addition, the annular surface 5*a* of the enlargement 5 is spaced relative to the interior wall 11*d* between the end of the splined arrangement 22 and the shoulder 11*e* formed on the housing 11 to again provide a relatively small annular fluid flow passage means which restricts flow of the substantially noncompressible medium in the upper chamber 40 upon relative longitudinal movement of the mandrel 10 and housing 11 to accomplish the desired dampening between the mandrel 10 and the housing 11.

Relative longitudinal downward movement between the mandrel 10 and housing 11 is limited by engagement of the shoulder 10*h* on the mandrel 10 with the end 11*b* of the housing and similarly relative upward movement between the mandrel 10 and housing 11 is limited by engagement of the upper end of enlargement 5 with shoulder 11*e* on housing 11.

As illustrated in FIGS. 4 and 5 of the drawings, the tool has been assembled and positioned in a drill string 30 with the portion 30 of the drill string being connected to the mandrel 10 and the housing 11 being secured to a drill bit 28. The present invention may be placed at any desired position in the drill string.

The downward drilling load normally exerted on the drill string during rotary drilling operation may be designated D, and the relative position of the mandrel 10 to the housing 11 under such predetermined or desired downward drilling load D will be such that the shoulder 10*h* is spaced from the end 11*b* of the housing as illustrated in FIGS. 4 and 5 during normal drilling operation. This distance or space between shoulder 10*h* on the mandrel 10 and the end 11*b* of the housing 11 is designated $S_1$ in FIG. 4 and during normal drilling operations, the shoulder 10*h* and 11*b* will be spaced relative apart within the distance $S_1$.

As previously noted, the portion 10*e* of the mandrel is substantially larger than the portion 10*b* so that a difference in cross sectional area is established at seal members 23 and 24. Since the cross sectional area at seal 24 is greater than the cross sectional area at seal 23, as mandrel 10 is slidably received into housing 11 during impact loading or shock loading, a piston effect is created which tends to force the fluid in upper chamber 45 through the restriction means, which may be referred to at 25, between the portions 10*f* of the mandrel and 11*c* of the housing and around the annular surface 5*a* of enlargement 5 and internal housing surface 11*d*.

Up and down drilling and shock or impact loading to the device is designated by the letter U and the letter D respectively adjacent the arrow in FIG. 5.

Similarly, rotational or radial work load and impact or shock loading to the right or to the left of the drill string is designated by the arrow and R and L in FIG. 5.

As previously mentioned, the tool is filled with a noncompressible medium such as lubricating oil in the upper chamber 45 and with a compressible fluid medium such as nitrogen, or a mixture of a compressible gas with miscible liquids in lower chamber 13 or compressible liquids and the charge in chamber 13 is initially such so that under the drilling load conditions to which the drill string will be normally subjected the shoulder 10*h* of mandrel 10 will be spaced longitudinally relative to the shoulder 11*b* of the housing. Similarly, the end of the enlargement 5 on the mandrel will be spaced relative to the shoulder 11*e* on the housing 11.

$d_1$ and $d_2$ are the diameters of mandrel portions 10*b* and 10*e* adjacent seals 23 and 24 respectively and the difference in cross sectional area is such that this area multiplied by the stroke $S_1$ between mandrel 10 and housing 11 is the volumetric displacement of the internal portions of the device as the mandrel 11 and its components telescope within the housing 11 due to drill load D. This, for the purposes of discussion, is defined as the load carrying ability of the tool. The compressible fluid in chamber 13 is utilized to resiliently carry the load D, as well as aid in translating normally rotary load (R-L) and any rotary or radial impact in either direction into a longitudinal component.

Chamber 13 will be charged with sufficient compressible medium such as oil or nitrogen to carry the normal drilling load and any longitudinal or rotary impact imparted to the drill bit and drill string.

The above may be defined as follows:

Load $D = (Ad_1 - Ad_2)(P)$;

and $P = D \div (Ad_1 - Ad_2)$ = internal pressure;

and $V_1 = (Ad_1 - Ad_2)S_1$.

Additionally, piston means 7 will move down mandrel 10 on threads 7*a* and 10*g* an amount designated $S_2$ on the drawings by the following formula:

$S_2 = V_2 \div (Ad_1 - Ad_b)$;

and $V_2 = S_2(Ad_1 - Ad_b)$;

$D$ = Load in lbs.

Where:

$Ad_1$ = Cross Sect. Area at $d$;

$Ad_2$ = Cross Sect. Area at $d_2$;

$Ad_b$ = Cross Sect. Area at $d_b$;

$S_1$ = Stroke or Displacement in inches;

$V_1$ = Displaced Volume in cubic inches;

$V_2$ = Piston means Displacement in cubic inches;

$S_2$ = Travel of Piston means;

$P$ = internal pressure generated by lead D acting on $Ad_1 - Ad_2$.

As previously noted, and as illustrated in FIGS. 4 and 5 when drilling load D is placed on the drilling string and on the tool of the present invention therein, piston means 7 is in a position of dynamic balance between the two shock dampening fluid mediums in chambers 45 and 13. When a radial or rotary load is placed, for example, on mandrel 10 either in a right or left direction, and assuming that the housing member 11 resists the direction and magnitude of the right or left loading between the mandrel 10 and external housing 11, the right or left radial loading or shock impact loading is converted into a vertical or longitudinal load factor by cooperation by the threads 7*a* and 10*g* by the common screw jack formula:

$$R \text{ or } L = (d_1 xp)/2\pi$$

and $$d_1 = 2\pi(R \text{ or } L)/P$$

Where:

$R$ or $L$ = Radial components converted into vertical load by thread 22;

$P$ = Thread Lead or Pitch;

$f$ = friction is neglected.

From the foregoing, it can be appreciated that piston means 7 serves as a means of converting radial or rotary loading into a vertical displacement of such piston means and thus converts rotary loading as well as rotary impact loading either in a right or left direction into a vertical or longitudinal component of force.

The fluid in chamber 13 acts on piston means 7 to position it so as to maintain mandrel 10 extended by an amount $S_1$ during normal drilling operations.

When either a longitudinal or rotary impact is applied to the drilling assembly, this will cause the mandrel to tend to telescope into housing 11 or withdraw therefrom. Either movement is retarded by the liquid in chamber 45 moving through the restriction means 25.

Piston means moves up or down mandrel 10 on threads 7*a* and 10*g* in response to radial loading and acting either against the liquid in chamber 45 or compressible medium in chamber 13, and by reason of its connection to housing 11 and mandrel 10 converts radial loading into a longitudinal component.

From the foregoing description, it can be seen that the present device provides an arrangement of converting both vertical or longitudinal loads in either an up or down direction, and radial loads either in a right or left direction into a single longitudinal component or load D which is capable of being carried by the fluids within the tool and in a way which permits relatively long displacements $S_1$ and $S_2$.

Thus, from the foregoing description, it can be seen that the present device is multidirectional in load carrying ability and in load shock absorbent capability in that it may provide dampening of a combination of the forces in either an up or down direction and in a right or left rotary direction.

Additionally, it should be noted that any stroke $S_1$ and $S_2$ may be designed in the tool by selecting $d_1$ and $d_2$ and the compressible fluid of proper values and magnitude. Since dampening or shock absorbing capability is provided by permitting restrictive motion between mandrel 10 and housing member 11, by adjusting the clearances between the enlargement 5 and internal housing surface 11*d* as well as between 10*f* and 11*c*, the length of period over which dampening occurs can be selectively varied.

The foregoing disclosure and description of the invention are illustrative and explanatory thereof, and various changes in the size, shape, and materials as well as in the details of the illustrated construction may be made without departing from the spirit of the invention.

What is claimed is:

1. In a device for connection in a well string to support the downward drilling work loads applied to the well string and to dampen radial and longitudinal shock loads applied to the well string comprising:

a. a housing;

b. a mandrel extending longitudinally therein;

c. cooperating means formed by said mandrel and housing to support the downward drilling work loads applied to the well string; and d. additional cooperating means formed by said mandrel and housing to dampen shock loads applied to the well string.

2. The invention of claim 1 including means engaging said mandrel and housing to translate radial loads applied to said housing into longitudinal loading of said mandrel.

3. The invention of claim 2 wherein said means engaging said mandrel and housing includes:

a. piston means;

b. means threadedly engaging said piston means on said mandrel; and c. a splined arrangement connecting said piston means and housing to accommodate relative longitudinal but nonrotational movement between said piston means and housing.

4. The invention of claim 1 wherein: said cooperating means includes:

a. first sealed chamber means formed between said mandrel and housing for receiving a compressible fluid medium therein; and b. piston means carried by said mandrel within the first sealed chamber against which the compressible fluid acts in response to loads applied to said housing;

and wherein said additional cooperating means includes:

a. second sealed chamber means formed between said mandrel and housing for receiving a substantially noncompressible fluid medium therein; and b. means for restricting fluid passage within said second sealed chamber to dampen shock loading on the device.

5. The invention of claim 4 including means rotatably supporting said piston means on said mandrel and means supporting said piston means for longitudinal but nonrotatable movement relative to said housing whereby relative rotation between said mandrel and housing tends to move said piston means into the second sealed chamber to increase the pressure of the compressible fluid within the second sealed chamber and transform radial forces between said mandrel and housing into a longitudinal component acting on said mandrel.

6. The invention of claim 4 wherein the means for restricting fluid passage includes an enlargement on said mandrel fitting closely adjacent said housing to restrict fluid flow from one side of said enlargement to the other upon relative longitudinal movement between said mandrel and housing.

7. In a device for connection in a well string to support the downward drilling work loads applied to the well string and to dampen rotational and longitudinal shock loads applied to the well string comprising:

a. a housing;

b. a mandrel extending longitudinally therein;

c. cooperating means connecting said mandrel and housing for supporting the downward drilling work loads applied to the well string and for converting rotational loads applied to said mandrel and housing into a longitudinal load; and d. additional cooperating means formed by said mandrel and housing to dampen shock loads applied to the well string.

8. The invention of claim 7 wherein: said cooperating means includes:

a. first sealed chamber means formed between said mandrel and housing for receiving a compressible fluid medium therein; and b. piston means carried by said mandrel within the first sealed chamber against which the compressible fluid acts in response to loads applied to said housing;

and wherein said additional cooperating means includes:

a. second sealed chamber means formed between said mandrel and housing for receiving a substantially noncompressible fluid medium therein; and b. means for restricting fluid passage within said second sealed chamber to dampen shock loading on the device.

9. The invention of claim 8 including means rotatably supporting said piston means on said mandrel and means supporting said piston means for longitudinal but nonrotatable movement relative to said housing whereby relative rotation between said mandrel and housing tends to move said piston means into the second sealed chamber to increase the pressure of the compressible fluid within the second sealed chamber and transform radial forces between said mandrel and housing into a longitudinal component acting on said mandrel.

10. The invention of claim 8 wherein the means for restricting fluid passage includes an enlargement on said mandrel fitting closely adjacent said housing to restrict fluid flow from one side of said enlargement to the other upon relative longitudinal movement between said mandrel and housing.

11. The invention of claim 7 wherein said means connecting said mandrel and housing for converting rotational loads includes:

a. piston means;

b. means threadedly engaging said piston means on said mandrel; and c. a splined arrangement connecting said piston means and housing to accommodate relative longitudinal but nonrotational movement between said piston means and housing.

12. A device for connecting into a rotary drill string for supporting the work load of the drill string and for absorbing substantial fluctuations in the work load due to rotational and longitudinal shocks comprising:

a. a housing;

b. means for connecting one end of said housing to the drill string;

c. a mandrel extending longitudinally of said housing and projecting through the other end thereof;

d. means for engaging said mandrel to the drill string;

e. first seal means between said housing and mandrel projecting therefrom;

f. second seal means between the other end of said mandrel and said housing;

g. said first and second seal means forming therebetween a chamber within said housing;

h. piston means threadedly carried on said mandrel;

i. means engaging said piston means to said housing to accommodate relative longitudinal movement therebetween;

j. seal means between said piston means and housing and between said piston means and mandrel for dividing the chamber formed between said first and second seal means into an upper and lower fluid receiving chamber;

k. fluid restriction means in the upper chamber for restricting movement of fluid therein to thereby retard relative movement between said mandrel and housing; and l. said piston means movable along said mandrel in response to radial loads between said mandrel and housing for translating the radial loads into a longitudinal component.

13. The invention of claim 12 including a substantially noncompressible fluid medium in said upper chamber, and wherein a compressible fluid medium is provided in said lower chamber.

14. The invention of claim 12 wherein said means engaging said piston means to said housing is a splined arrangement to accommodate longitudinal and nonrotational relative movement between said mandrel and housing.

15. The invention of claim 12 wherein said lower fluid receiving chamber includes:

a. a movable barrier therein; and b. seal means on said barrier for sealingly engaging said mandrel and said housing.

16. A device for connecting into a rotary drill string for supporting the work load of the drill string and for absorbing substantial fluctuations in the work load due to rotational and longitudinal shocks comprising:

a. a housing;

b. means for connecting one end of said housing to the drill string;

c. a mandrel extending longitudinally of said housing and projecting through the other end thereof;

d. means for engaging said mandrel to the drill string;

e. first seal means between said housing and mandrel projecting therefrom;

f. second seal means between the other end of said mandrel and said housing;

g. said first and second seal means forming therebetween a chamber within said housing;

h. piston means threadedly carried on said mandrel;

i. means engaging said piston means to said housing to accommodate relative longitudinal movement therebetween;

j. seal means between said piston means and housing and between said piston means and mandrel for dividing the chamber formed between said first and second seal means into an upper and lower fluid receiving chamber; and k. fluid restriction means in the upper chamber for restricting movement of fluid therein to thereby retard relative movement between said mandrel and housing.

17. A device for connecting into a rotary drill string for supporting the work load of the drill string and for absorbing substantial fluctuations in the work load due to rotational and longitudinal shocks comprising:

a. a housing;

b. means for connecting one end of said housing to the drill string;

c. a mandrel extending longitudinally of said housing and projecting through the other end thereof;

d. means for engaging said mandrel to the drill string;

e. first seal means between said housing and mandrel projecting therefrom;

f. second seal means between the other end of said mandrel and said housing;

g. said first and second seal means forming therebetween a chamber within said housing;

h. piston means threadedly carried on said mandrel;

i. means engaging said piston means to said housing to accommodate relative longitudinal movement therebetween;

j. seal means between said piston means and housing and between said piston means and mandrel for dividing the chamber formed between said first and second seal means into a first and second fluid receiving chamber; and k. fluid restriction means in said first chamber for restricting movement of fluid therein to thereby retard relative movement between said mandrel and housing and absorb shock loads applied thereto.

18. The invention of claim 17 wherein said piston means extends into said second fluid receiving chamber and is responsive to radial loads applied to the device for translating the radial loads into longitudinal components.

* * * * *